United States Patent [19]

Hewitt

[11] 4,194,875

[45] Mar. 25, 1980

[54] INTERMITTENT PILOT IGNITION SYSTEM

[75] Inventor: William L. Hewitt, Woodland Hills, Calif.

[73] Assignee: Cam-Stat Incorporated, Los Angeles, Calif.

[21] Appl. No.: 870,245

[22] Filed: Jan. 17, 1978

[51] Int. Cl.[2] ..... F23Q 9/08

[52] U.S. Cl. ..... 431/45; 431/46; 431/71; 431/73

[58] Field of Search ..... 431/45, 46, 71, 73, 431/74

[56] References Cited

U.S. PATENT DOCUMENTS

| | | | |
|---|---|---|---|
| 2,662,591 | 12/1953 | Hanson | 431/45 |
| 3,813,581 | 5/1974 | Hewitt | 431/264 X |
| 3,938,937 | 2/1976 | Matthews | 431/71 X |
| 3,975,136 | 8/1976 | Baysinger et al. | 431/74 |
| 3,986,813 | 10/1976 | Hewitt | 431/46 |
| 4,124,354 | 11/1978 | Gann | 431/46 |

*Primary Examiner*—Carroll B. Dority, Jr.
*Assistant Examiner*—Margaret A. Focarino
*Attorney, Agent, or Firm*—Harris, Kern, Wallen & Tinsley

[57] ABSTRACT

A system for controlling the pilot and main burner gas valves of a gas furnace or the like, including a pilot spark ignitor and a pilot flame sensor. A main burner valve control circuit for energizing the spark ignitor until a pilot flame is sensed and then energizing the main burner valve solenoid to provide gas to the main burner. A pilot solenoid valve control circuit for controlling application of power to the ignitor circuit and the pilot and main solenoids. A safety turn on control circuit which permits operation of the pilot valve and ignitor circuit for only a limited period of time to provide a fail safe operation of the ignition system.

9 Claims, 1 Drawing Figure

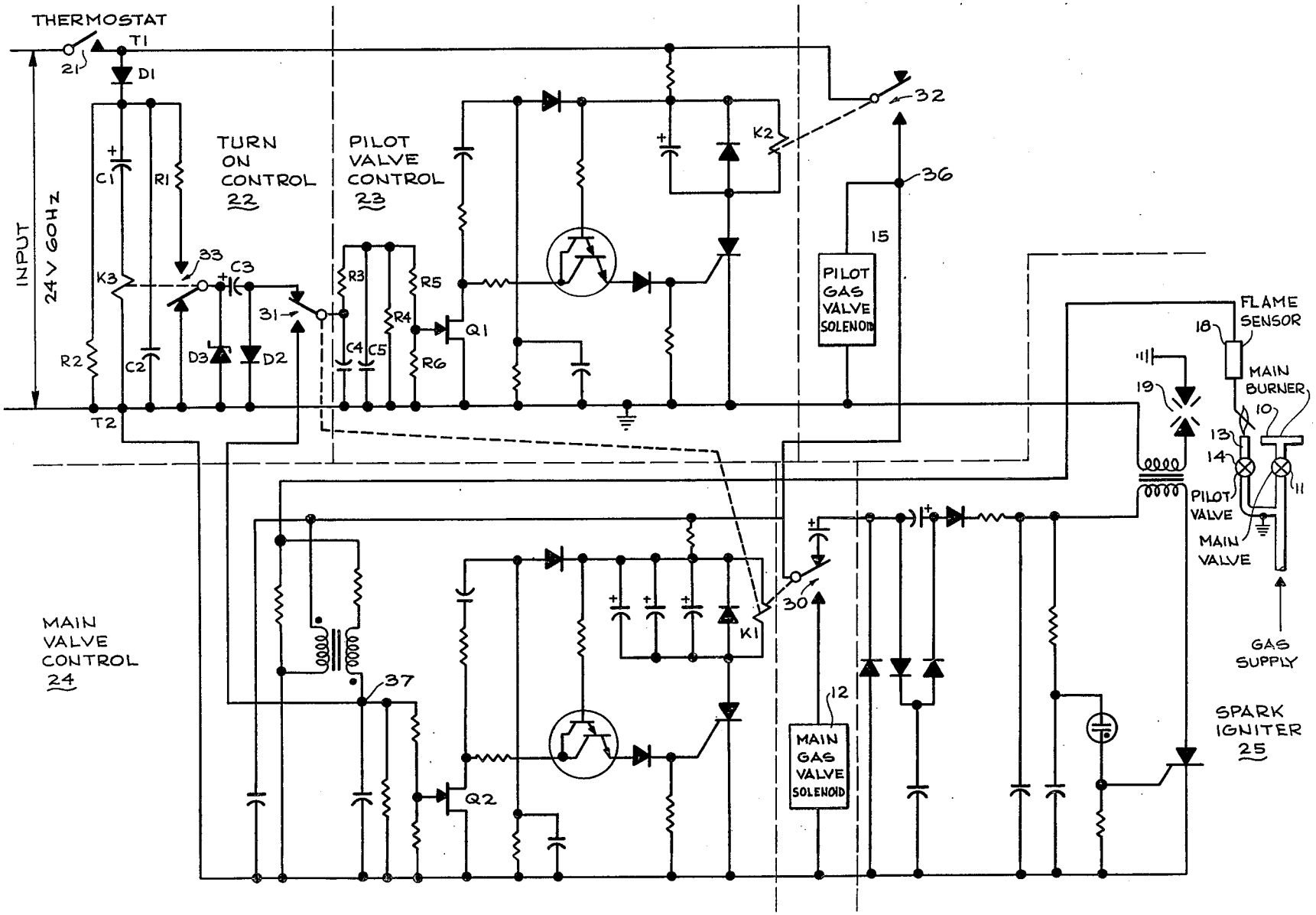
FLAME SENSOR
MAIN BURNER
GAS SUPPLY
SPARK IGNITER 25
PILOT VALVE
MAIN VALVE
PILOT GAS VALVE SOLENOID
MAIN GAS VALVE SOLENOID
PILOT VALVE CONTROL 23
TURN ON CONTROL 22
MAIN VALVE CONTROL 24
THERMOSTAT
INPUT
24V 60HZ

INTERMITTENT PILOT IGNITION SYSTEM

BACKGROUND OF THE INVENTION

This invention relates to gas burner controls for furnaces and the like, and in particular to a new and improved pilot burner gas ignitor and main burner valve controller. This system utilizes a pilot burner flame sensor and a control circuit for switching the main burner solenoid valve and the pilot burner spark ignitor circuit.

A typical system of this type is energized when the electrical contacts of a thermostat close in response to a drop in temperature of the area being heated by the gas furnace. When the thermostat switch closes, the pilot burner valve is opened and the spark ignitor circuit provides sparking at the pilot ignitor electrodes and the gas at the pilot burner should ignite. The flame sensor and control circuit detects the existance of the flame and actuates a switching circuit to energize the main burner valve and turn off the spark ignitor circuit. If flame outage occurs, the flame sensing circuitry will detect the absence of flame and close the main burner valve, while at the same time turning on the spark ignitor for reigniting the pilot burner.

Systems of this general type are known, and one such system is shown in U.S. Pat. No. 3,986,813. Other known systems are discussed in said patent.

However, there is a problem with the prior art systems. There is a possibility that the pilot burner will not ignite eventhough the pilot burner valve is open and the ignitor circuit is producing sparks. Under these circumstances, gas continues to flow from the pilot burner. When the fuel is natural gas, there is little problem, since this gas is lighter than air and the unburned gas goes up the flue. However, fuels which are heavier than air such as propane and butane are also being utilized. Under the situation referred to above, the unburned gas being heavier than air will collect in the area around the burners and there is a possibility that this fuel would be ignited by the sparking of the ignitor circuit, producing an undesired explosion.

Therefore, it is an object of the present invention to provide a new and improved ignition control system which will limit the spark ignitor action to a predetermined time, regardless of other conditions of the control system. A further object is to provide such a new and improved control system having fail safe characteristics so that the protection against continuous ignitor operation is achieved eventhough there is failure in the control components.

SUMMARY OF THE INVENTION

The control system of the invention utilizes the now conventional components of a pilot ignition and valve control system including a main burner, a main valve operated by a main solenoid for providing gas to the main burner, a pilot burner, a pilot valve operated by a pilot solenoid for providing gas to the pilot burner, a flame sensor and a flame sensor circuit providing a flame signal, ignition electrodes and an ignition circuit for driving the electrodes, a first switching circuit for controlling the ignition circuit and the main burner, a main valve control circuit for the first switching circuit, and input terminals for connection to the AC power source through the thermostat switch.

The new components of the combination include a storage capacitor, a charging circuit for charging the storage capacitor when the thermostat switch is initially closed and thereafter automatically disconnecting the storage capacitor from the charging circuit so that the closed thermostat switch does not continue to provide a turn on activity, a second switching circuit for providing power to the first switching circuit and the pilot valve solenoid, and a pilot valve control circuit for the second switching circuit. The pilot valve control circuit is actuated by the discharge of the storage capacitor and by the flame signal from the flame sensor depending upon the state of the system. A time delay circuit provides for discharge of the storage capacitor during ignition operation so that ignition operation can proceed for only a predetermined length of time regardless of the conditions at the burners. Ignition operation is initiated by a two-step sequence of first charging and then discharging the storage capacitor thereby providing the desired safety operation.

BRIEF DESCRIPTION OF THE DRAWING

The single FIGURE of the drawing is an electrical schematic of a furnace control incorporating the presently preferred embodiment of the invention.

DESCRIPTION OF THE PREFERRED EMBODIMENT

The gas flow to a main burner 10 is controlled by a valve 11 actuated by a valve solenoid 12. Gas flow to a pilot burner 13 is controlled by a valve 14 actuated by a valve solenoid 15. A rod type flame sensor 18 and a pair of ignition electrodes 19 are positioned adjacent the pilot burner 13. All of these components may be conventional.

A conventional thermostat switch 21 serves to connect a 24 volt AC power supply across terminals T1, T2 when the main burner is to be turned on. The circuitry of the system includes a turn on control 22, a pilot valve control 23, a main valve control 24, and a spark ignitor 25. The main valve control 24 energizes a relay K1 with a contact set 30 and another contact set 31. The pilot valve control 23 energizes a relay K2 with a contact set 32. Another relay K3 with contact set 33 is included in the turn on control 22. The relays are shown in the unenergized state in the drawing.

The pilot valve control 23 and the main valve control 24 may be conventional and as shown in the drawing correspond to the main valve control 22 of aforesaid U.S. Pat. No. 3,986,813. The spark ignitor 25 may be conventional and as shown corresponds to the spark ignitor of U.S. Pat. No. 3,813,581 and the spark ignitor 23 of the aforesaid U.S. Pat. No. 3,986,813.

In the turn on control 22, the coil of relay K3 is connected in series with capacitor C1 and diode D1 across terminals T1, T2. Capacitor C2 and resistor R1 provide a filtering function for the half wave AC produced by diode D1. When the thermostat switch 21 is closed, capacitor C1 is charged through the coil of relay K3, thereby energizing the relay and moving the arm of contact set 33 up to connect storage capacitor C3 to terminal T1 through resistor R1 and diode D1. When capacitor C1 is charged, current in the coil K3 ceases, the relay is deenergized, and the arm of contact set 33 moves to the low position connecting the storage capacitor C3 to terminal T2. Relay K3 remains in the unenergized position until the thermostat switch 21 is opened and again closed. Resistor R2 provides a discharge path for capacitors C1 and C2 when the system is deenergized. This ensures that C1 will be in a state to accept full charge when the system is energized thus allowing K3 to pull-in momentarily.

Diode D3 is a 15 volt Zener which limits the charge on the capacitor C3. The capacitor C3 is connected to the control electrode of field effect transistor Q1 through the contact set 31, and the resistor-capacitor network of resistors R3, R4, R5 and capicitor C4, C5.

When storage capacitor C3 is charged through diode D1, the left terminal of the capacitor is positive. When relay K3 is deenergized, the left terminal of capacitor C3 is connected to terminal T2 as a reference point, which makes the right terminal of capacitor C3 negative with respect to circuit ground. This negative voltage is connected at the control electrode of transistor Q1 switching it into conduction and this ultimately energizes the coil of relay K2 moving contact set 32 and connecting terminal T1 to point 36. For details of operation of the pilot valve control 23, reference may be had to the aforementioned U.S. Pat. No. 3,986,813. While positive and negative voltages are referred to, it will be realized that negative and positive voltages may be utilized by changing the type of components, and that it is the sequence of polarity change which is significant.

Applying power at point 36 provides power to the spark ignitor 25 through contact set 30, providing sparks at the electrodes 19. Applying power at point 36 also energizes the pilot gas valve solenoid 15 to open pilot valve 14 and provides gas at the pilot burner 13. Power at point 36 also provides power to the main valve control 24.

When a flame is sensed by the flame sensor 18, a flame signal is provided at point 37 providing a negative voltage to the control electrode of the field effect transistor Q2 in the main valve control 24. The main valve control 24 operates in the same manner as the pilot valve control 23 to energize relay K1 and switch power from the spark ignitor 25 to the main gas valve solenoid 12. This opens main valve 11 providing gas to the main burner 10 which is ignited by the flame of the pilot burner 13. The furnace is now in normal operation.

Actuation of relay K1 also actuates contact set 31 to disconnect the storage capacitor C3 and connect the flame signal from point 37 as the input to the pilot valve control 23. Thus, the flame signal from the flame sensor maintains both relay K1 and relay K2 energized thereby maintaining both valve solenoids energized and both valves open. When the thermostat switch 21 opens indicating that heat is no longer required, all power is removed, both solenoids are deenergized and relays K1 and K2 are deenergized.

In the prior art devices, the ignitor circuit was continuously energized until there was a pilot flame. However, the turn on control 22 of the present control system limits the time during which the spark ignitor is energized in the event there is no flame. As discussed previously, capacitor C3 is charged only at the time the thermostat switch 21 is closed and is not charged again until the switch 21 is opened and reclosed. If for any reason relay K3 remains energized or is reenergized, there will be no effective input to the pilot valve control 23, since the negative signal for transistor Q1 is obtained only by connecting the capacitor C3 to the reference point by the contact set 33. When the charged capacitor C3 is connected to the reference point by contact set 33 and to transistor Q1 by contact set 31, the capacitor is discharged through the resistance-capacitance network at a rate determined by the parameters of the network. In the preferred embodiment, the parameters are selected to discharge the capacitor in about 60 seconds. After the capacitor C3 is discharged, there will be no negative signal at transistor Q1 and relay K2 cannot be energized. Hence, if there is no flame sensed within this preset 60 second period, relay K2 cannot be energized until thermostat switch 21 is opened and reclosed. This prevents any continuous operation of the spark ignitor beyond the initial 60 second period.

If a flame out occurs, there will be no flame sensed and no flame signal at point 37. Relay K1 will be deenergized, closing the main burner valve and energizing the ignitor circuit. At the same time, capacitor C3 will again be connected to transistor Q1 through contact set 31 and if there is any charge remaining on capacitor C3, transistor Q1 will be maintained in conduction, maintaining relay K2 energized and maintaining power to the spark ignitor circuit. Under normal conditions, this provides an adequate relight function since the pilot burner is ordinarily ignited in 5 to 10 seconds. Under normal conditions, capacitor C3 will be charged to provide the desired output for about 60 seconds, leaving a substantial charge after initial ignition. Of course a low leakage capacitor is desired. If the flame is not reignited within the time permitted by the further discharge of capacitor C3, the system will be off until the thermostat switch is opened and reclosed.

The turn on control 22 is also safe for failure of components. If the relay K3 fails in the unenergized position, the capacitor C3 cannot be charged. If the relay fails in the energized position, the capacitor C3 cannot be switched to the reference point to provide the proper polarity of voltage to the transistor Q1. Short circuiting or open circuiting or shorting to ground of the various components of the turn on control will prevent the sequence of operations required to achieve the negative voltage at Q1.

Hence, it is seen that the control system of the invention provides for flame ignition and at the same time prevention of continuous sparking when there is no ignition and a fail safe operation for component failure.

Typical values for certain of the components are set out in the following table. Reference may be made to the aforementioned U.S. Patents for typical values of the remaining components.

| Component | Description |
|---|---|
| C1 | 50 mfd capacitor |
| C2 | 50 mfd capacitor |
| C3 | 2 mfd capacitor |
| C4 | .01 mfd capacitor |
| C5 | .01 mfd capacitor |
| R1 | 1 kohm resistor |
| R2 | 1.8 kohm resistor |
| R3 | 1.3 megohm resistor |

I claim:

1. In a pilot ignition and valve control system for a gas burner having a main burner, a main valve operated by a main solenoid for providing gas to said main burner, a pilot burner, and a pilot valve operated by a pilot solenoid for providing gas to said pilot burner, a flame sensor and a flame sensor circuit for providing a flame signal when the pilot burner is ignited, ignition electrodes adjacent said pilot burner and an ignition circuit for connection to said ignition electrodes, a first switching circuit operable between a first condition turning said ignition circuit on to provide sparking at said electrodes, and a second condition turning said ignition circuit off and supplying gas to said main burner, a main valve control circuit for said first switching circuit and having the flame signal of said flame sensor circuit as an input, whereby when a flame is sensed at said pilot burner said main valve control circuit actuates said first switching circuit from said first condition to said second condition, and a pair of input terminals for connection to an AC power source through a thermostat switch, the improvement including in combination:

a storage capacitor;

a charging circuit connected to said input terminals for charging said capacitor when the thermostat switch is closed, and including means for automatically disconnecting said capacitor from said charging circuit at a time after said thermostat switch is closed and connecting said capacitor to a reference point;

a second switching circuit operable between a first open condition and a second condition connecting said input terminals to said first switching circuit and to said pilot solenoid; and a pilot valve control circuit for said second switching circuit and having first means for connecting said capacitor as an input, whereby when said capacitor is charged and connected to said reference point said pilot valve control circuit actuates said second switching circuit from said first condition to said second condition supplying gas to said pilot burner and power to said ignition electrodes.

2. A system as defined in claim 1 wherein said first means for connecting includes means for disconnecting said capacitor as an input and connecting said flame signal as an input.

3. A system as defined in claim 2 wherein said first means for connecting includes a portion of said first switching circuit.

4. A system as defined in claim 2 wherein said pilot valve control circuit includes means for discharging said capacitor at a predetermined rate.

5. A system as defined in claim 2 wherein said charging circuit includes:

a relay coil and a second capacitor connected in series across said input terminals; and a set of relay contacts for selectively connecting said storage capacitor to an input terminal and to said reference point;

with closing of the thermostat switch charging said second capacitor through said relay coil actuating said set of contacts to connect said storage capacitor to an input terminal to charge said storage capacitor, and with current in said relay coil stopping when said second capacitor is charged deenergizing said coil with said set of contacts switching to connect said storage capacitor to said reference point.

6. A system as defined in claim 5 wherein said reference point is the other of said input terminals.

7. A system as defined in claim 5 wherein said pilot valve control circuit includes means for discharging said storage capacitor at a predetermined rate.

8. A system as defined in claim 1 wherein said charging circuit includes:

a relay coil and a second capacitor connected in series across said input terminals; and a set of relay contacts for selectively connecting said storage capacitor to an input terminal and to said reference point;

with closing of the thermostat switch charging said second capacitor through said relay coil actuating said set of contacts to connect said storage capacitor to an input terminal to charge said storage capacitor, and with current in said relay coil stopping when said second capacitor is charged deenergizing said coil with said set of contacts switching to connect said storage capacitor to said reference point.

9. A system as defined in claim 1 wherein said pilot valve control circuit includes means for discharging said capacitor at a predetermined rate.

* * * * *